US012252857B2

(12) United States Patent
Wang et al.

(10) Patent No.: US 12,252,857 B2
(45) Date of Patent: Mar. 18, 2025

(54) CONSTRUCTION METHOD FOR REMOVING MUD IN JACKET STEEL PIPE PILE

(71) Applicants: CCCC SHANGHAI HARBOUR ENGINEERING DESIGN & RESEARCH INSTITUTE CO., LTD., Shanghai (CN); CCCC HARBOUR (SHANGHAI) SCIENCE & TECHNOLOGY CO., LTD., Shanghai (CN); CCCC SHANGHAI THIRD HARBOUR ENGINEERING SCIENCE & TECHNOLOGY RESEARCH INSTITUTE CO., LTD., Shanghai (CN); CCCC THIRD HARBOR ENGINEERING CO., LTD., Shanghai (CN)

(72) Inventors: Dongdong Wang, Shanghai (CN); Hui Liu, Shanghai (CN); Dapeng Wang, Shanghai (CN); Haibing Wu, Shanghai (CN); Dongliang Lv, Shanghai (CN); Xuan Sun, Shanghai (CN); Heng Zhang, Shanghai (CN)

(73) Assignees: CCCC SHANGHAI HARBOUR ENGINEERING DESIGN & RESEARCH INSTITUTE CO., LTD., Shanghai (CN); CCCC HARBOUR (SHANGHAI) SCIENCE & TECHNOLOGY CO., LTD., Shanghai (CN); CCCC SHANGHAI THIRD HARBOUR ENGINEERING SCIENCE & TECHNOLOGY RESEARCH INSTITUTE CO., LTD., Shanghai (CN); CCCC THIRD HARBOR ENGINEERING CO., LTD., Shanghai (CN)

( * ) Notice: Subject to any disclaimer, the term of this patent is extended or adjusted under 35 U.S.C. 154(b) by 0 days.

(21) Appl. No.: 18/729,184

(22) PCT Filed: Apr. 20, 2023

(86) PCT No.: PCT/CN2023/089552
§ 371 (c)(1),
(2) Date: Jul. 16, 2024

(87) PCT Pub. No.: WO2023/207754
PCT Pub. Date: Nov. 2, 2023

(65) Prior Publication Data
US 2025/0003170 A1 Jan. 2, 2025

(30) Foreign Application Priority Data
Apr. 25, 2022 (CN) ..... 202210441427.X

(51) Int. Cl.
*E02D 13/08* (2006.01)
*E02B 17/02* (2006.01)
*E02D 7/00* (2006.01)

(52) U.S. Cl.
CPC ..... *E02D 13/08* (2013.01); *E02B 17/02* (2013.01); *E02D 7/00* (2013.01)

(58) Field of Classification Search
CPC ..... E02D 13/08; E02D 7/00; E02B 17/02
See application file for complete search history.

(56) References Cited

U.S. PATENT DOCUMENTS

2018/0340312 A1 11/2018 Zhou et al.
2020/0306803 A1* 10/2020 Jacobsen ..... E02D 7/24

FOREIGN PATENT DOCUMENTS

CN 108487248 A 9/2018
CN 209742787 U 12/2019
(Continued)

*Primary Examiner* — Janine M Kreck
(74) *Attorney, Agent, or Firm* — Bayramoglu Law Offices LLC

(57) ABSTRACT

A construction method for removing mud in a jacket steel pipe pile includes: erecting a piling auxiliary platform, and performing underwater steel pipe pile sinking; measuring an elevation of a mud surface in the underwater steel pipe pile, and calculating a height from the mud surface in the pile to a pile top and a needed mud removing depth according to the measurement result; installing mud removing equipment on the steel pipe pile; starting the mud removing equipment to carry out mud removing operation, and in a case that the mud removing depth is reached, pausing the mud removing equipment, and cleaning an inner wall of the steel pipe pile; and in a case that the mud removing operation is not reach
(Continued)

the related elevation, repeating the mud removing operation till the mud removing operation reaches a standard.

16 Claims, 6 Drawing Sheets

(56) References Cited

FOREIGN PATENT DOCUMENTS

| | | | |
|---|---|---|---|
| CN | 111691423 | A | 9/2020 |
| CN | 113356211 | A | 9/2021 |
| CN | 215718564 | U | 2/2022 |
| CN | 114293558 | A | 4/2022 |
| CN | 114775612 | A | 7/2022 |
| CN | 114808980 | A | 7/2022 |

* cited by examiner

CONSTRUCTION METHOD FOR REMOVING MUD IN JACKET STEEL PIPE PILE

CROSS REFERENCE TO THE RELATED APPLICATIONS

This application is the national phase entry of International Application No. PCT/CN2023/089552, filed on Apr. 20, 2023, which is based upon and claims priority to Chinese Patent Application No. 202210441427.X, filed on Apr. 25, 2022, the entire contents of which are incorporated herein by reference.

TECHNICAL FIELD

This application belongs to the technical field of offshore wind power foundation construction, and in particular to a construction method for removing mud in a jacket steel pipe pile.

BACKGROUND

With the rapid development of offshore wind power development in China, the site selection of wind farms is rapidly moving towards deeper and farther sea areas, and the application of jacket wind turbine foundation is increasing. The construction technology of a "piling in advance type" interpolated jacket foundation is mainly as follows: underwater steel pipe pile sinking is performed through an auxiliary platform, mud in the steel pipe pile is removed to reach a design elevation, and grouting of the connecting section is carried out after installing an upper jacket. High efficiency and quality of mud removing construction is an important factor affecting the construction progress and grouting quality of the site. For the mud removing construction in the pile, a traditional process mainly includes divers entering the water to remove mud and gas lift circulating mud removing, etc., construction efficiency is low, and requirements for personnel, ship and equipment are high. In the process of mud removing, the mud suction equipment and personnel are often in the steel pipe pile at the same time, the danger factor is large, and the space is not conducive to operation. Therefore, mud removing in the "piling in advance type" interpolated jacket foundation steel pipe pile has always been an important factor affecting the construction progress of offshore wind power jacket, important nodes and grouting quality.

SUMMARY

In order to overcome defects or shortcomings in the prior art, the technical problem to be solved in this application is to provide a construction method for removing mud in a jacket steel pipe pile. The construction method is suitable for construction through an auxiliary platform before the auxiliary platform is dismantled, and meanwhile suitable for construction through a construction ship after the auxiliary platform is dismantled. The construction process has advantages that the construction method is simple and efficient, requirements for personnel is low, soil layers of different types of geology can be constructed, and off-shore operation time and construction costs are reduced.

In order to solve the technical problem above, this application is implemented through the following technical solutions.

This application provides a construction method for removing mud in a jacket steel pipe pile, including:

erecting a piling auxiliary platform, and performing underwater steel pipe pile sinking;

measuring an elevation of a mud surface in the underwater steel pipe pile, and calculating a height from the mud surface in the pile to a pile top and a needed mud removing depth according to the measurement result;

installing mud removing equipment on the steel pipe pile;

starting the mud removing equipment to carry out mud removing operation, and in a case that the mud removing depth is reached, pausing the mud removing equipment, and cleaning an inner wall of the steel pipe pile; and in a case that the mud removing operation is not reach the related elevation, repeating the mud removing operation till the mud removing operation reaches a standard.

Optionally, according to the above construction method for removing mud in a jacket steel pipe pile, the installing mud removing equipment on the steel pipe pile includes:

connecting an air compressor connector on a platform or a construction deck with an adapter of the mud removing equipment;

and/or, clamping the mud removing equipment to the top portion of the steel pipe pile;

and/or, selecting a proper drill bit assembly to be installed on a transmission main shaft of the mud removing equipment;

and/or, adjusting a climbing device in the mud removing equipment and adjusting a length of the transmission main shaft, controlling a pile entering depth of the drill bit assembly, and starting a height adjusting hydraulic device to fix the trans-mission main shaft and then unhooking the transmission main shaft.

Optionally, according to the above construction method for removing mud in a jacket steel pipe pile, the installing mud removing equipment on the steel pipe pile further includes: starting a driving assembly, and under driving effect of the driving assembly, adjusting a rotating speed of a transmission main shaft and a rotating speed of a drill bit assembly installed at a bottom portion of the transmission main shaft; and/or, starting a mud suction pump to remove mud and pumping the mud out of the steel pipe pile.

Optionally, according to the above construction method for removing mud in a jacket steel pipe pile, the installing mud removing equipment on the steel pipe pile further includes: pausing the driving assembly and the mud suction pump, and increasing a pile entering depth of a drill bit by adjusting a climbing device till the needed mud removing depth is reached.

Optionally, according to the above construction method for removing mud in a jacket steel pipe pile, in a case that the expected mud removing depth is reached, pausing the driving assembly and the mud suction pump, starting the climbing device, starting an air compressor to inject high-pressure air into the steel pipe pile, performing reciprocating lifting in a mud removing depth interval, and cleaning the inner wall of the steel pipe pile; and in a case that the expected mud removing depth is not reached, repeating the mud removing operation till the expected mud removing depth is reached, then pausing the driving assembly and the mud suction pump, starting the climbing device, starting the air compressor to inject high-pressure air into the steel pipe pile, performing reciprocating lifting in the mud removing depth interval, and cleaning the inner wall of the steel pipe pile.

Optionally, according to the above construction method for removing mud in a jacket steel pipe pile, a pipeline between the mud suction pump and the mud removing equipment is a steel pipeline or a steel wire hose, and/or, a pipeline between the air compressor and the mud removing equipment is a rubber hose.

Optionally, according to the above construction method for removing mud in a jacket steel pipe pile, the driving assembly is further provided with a torque sensor, and the completed mud removing depth can be obtained based on a numerical value of the torque sensor and in combination with the mud removing depth measured by construction.

Optionally, according to the above construction method for removing mud in a jacket steel pipe pile, the mud suction pumps are evenly distributed along the transmission main shaft, and the mud suction pumps are in bearing type rotary connection with the transmission main shaft.

Optionally, according to the above construction method for removing mud in a jacket steel pipe pile, the needed mud removing depth H=an elevation $H_1$ of the mud surface in the measured pile—an elevation $H_2$ of a designed mud surface in the pile.

Optionally, according to the above construction method for removing mud in a jacket steel pipe pile, the mud removing equipment is installed in a rigid lifting cage; a lower frame of the rigid lifting cage is welded to a lower portion of a pile head support of the mud removing equipment, and a center of the pile head support is rotationally connected to the transmission main shaft through a bearing; and a clamping groove is formed in the lower portion of the pile head support and the clamping groove is connected to an end portion of the steel pipe pile in a clamped mode.

Compared with the prior art, this application has the following technical effects.

According to this application, the construction process for removing the mud in the steel pipe pile is introduced from aspects of on-site equipment assembly, pipeline connection, equipment operation, construction sequence and the like for mud removing in the underwater steel pipe pile. Construction effect is good, efficiency is high, personnel allocation requirements is low, offshore operation windows and construction costs are reduced, and a powerful guarantee is provided for ensuring safety and quality of an offshore wind turbine foundation.

According to this application, construction is carried out based on existing mud removing equipment and an offshore auxiliary piling platform, the equipment assembly is simple, the pipeline connection is convenient, and problems that the mud surface in the steel pipe pile is not removed to the designed elevation, phenomena of pile bottom back silting and the like occur, and installation of an upper jacket is affected are effectively solved.

BRIEF DESCRIPTION OF THE DRAWINGS

The other features, purposes and advantages of this application will become more apparent by reading the detailed description of the non-restrictive embodiments with reference to the following accompanying drawings.

DETAILED DESCRIPTION OF THE EMBODIMENTS

The technical solutions in embodiments of this application are clearly and completely described in the following with reference to the accompanying drawings in the embodiments of this application. Apparently, the described embodiments are merely some rather than all of the embodiments of this application. All other embodiments obtained by a person of ordinary skill in the art based on the embodiments of this application without creative efforts shall fall within the protection scope of this application.

Figure 1:
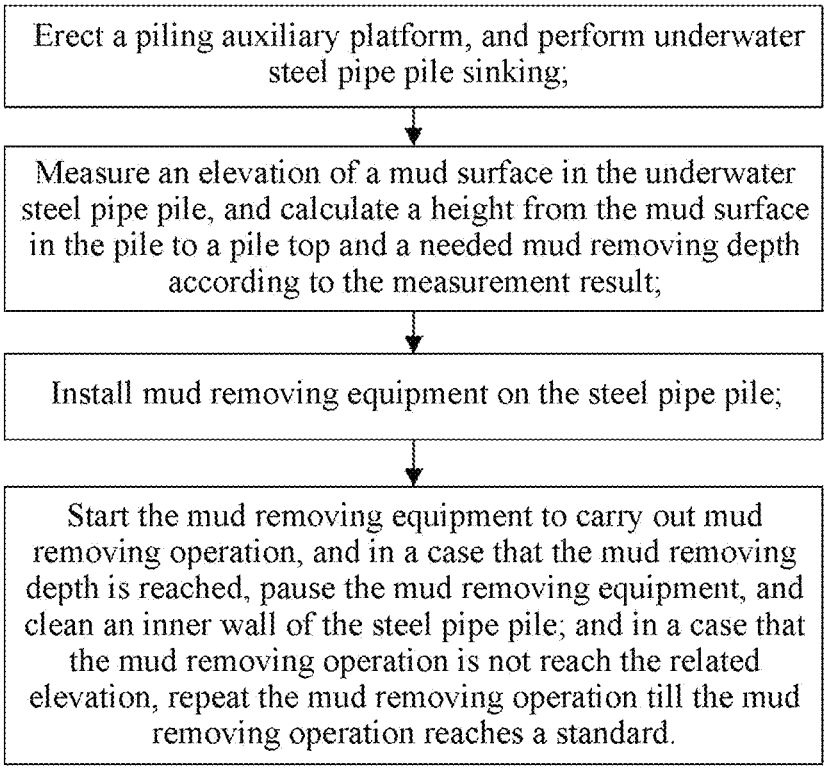
FIG. 1: a frame diagram of a construction method for removing mud in a jacket steel pipe pile according to an embodiment of this application.

As shown in FIG. 1, in one embodiment of this application, a construction method for removing mud in a jacket steel pipe pile includes:

- step 1, erecting a piling auxiliary platform M1, and performing underwater steel pipe pile 5 sinking;
- step 2, measuring an elevation of a mud surface in the underwater steel pipe pile 5, and calculating a height from the mud surface in the pile to a pile top and a needed mud removing depth according to the measurement result;
- step 3, installing mud removing equipment M7 on the steel pipe pile 5;
- step 4, starting the mud removing equipment M7 to carry out mud removing operation, and in a case that the mud removing depth is reached, pausing the mud removing equipment M7, and cleaning an inner wall of the steel pipe pile 5; and in a case that the mud removing operation is not reach the related elevation, repeating the mud removing operation till the mud removing operation reaches a standard.

This embodiment is suitable for construction through the auxiliary platform M1 before the auxiliary platform M1 is dismantled, and meanwhile suitable for construction through a construction ship after the auxiliary platform M1 is dismantled. The construction process has advantages that the construction method is simple and efficient, requirements for personnel is low, soil layers of different types of geology can be constructed, and offshore operation time and construction costs are reduced.

The mud removing equipment M7 according to this embodiment includes: a transmission main shaft 9, a mud suction mechanism, a pile head support 2, a driving assembly and a drill bit assembly. The transmission main shaft 9 is arranged inside the steel pipe pile 5, and the transmission main shaft 9 is of a hollow structure. The mud suction mechanism is installed at a top portion of the transmission main shaft 9. A center of the pile head support 2 is rotationally connected with the transmission main shaft 9, and an outer side of the pile head support is installed at an end portion of the steel pipe pile 5. The driving assembly includes a driving component and a driven component connected with the driving component, and the driven component is arranged on the transmission main shaft 9. The drill bit assembly is installed at a bottom portion of the transmission main shaft 9.

In this embodiment, the transmission main shaft 9 is installed and fixed through a height adjusting hydraulic device, and/or, a guide compass 14 is further arranged on an outer side of the transmission main shaft 9. A diameter of the guide compass 14 is slightly larger than the maximum diameter of the drill bit assembly (such as a diameter of an external mud cutting turbine 11), so that the device is conveniently placed into the pile, and meanwhile, a situation that a drill bit collides with the inner wall of the steel pipe pile 5 due to shaking before the device is fixed and in the construction process is prevented. In this embodiment, the transmission main shaft 9 is installed and fixed through the height adjusting hydraulic driving device, and the height adjusting hydraulic device is mainly used for fixing the transmission main shaft 9. Through the arrangement, rotation or up-down movement and the like of the transmission main shaft 9 can be guaranteed.

Figure 2:
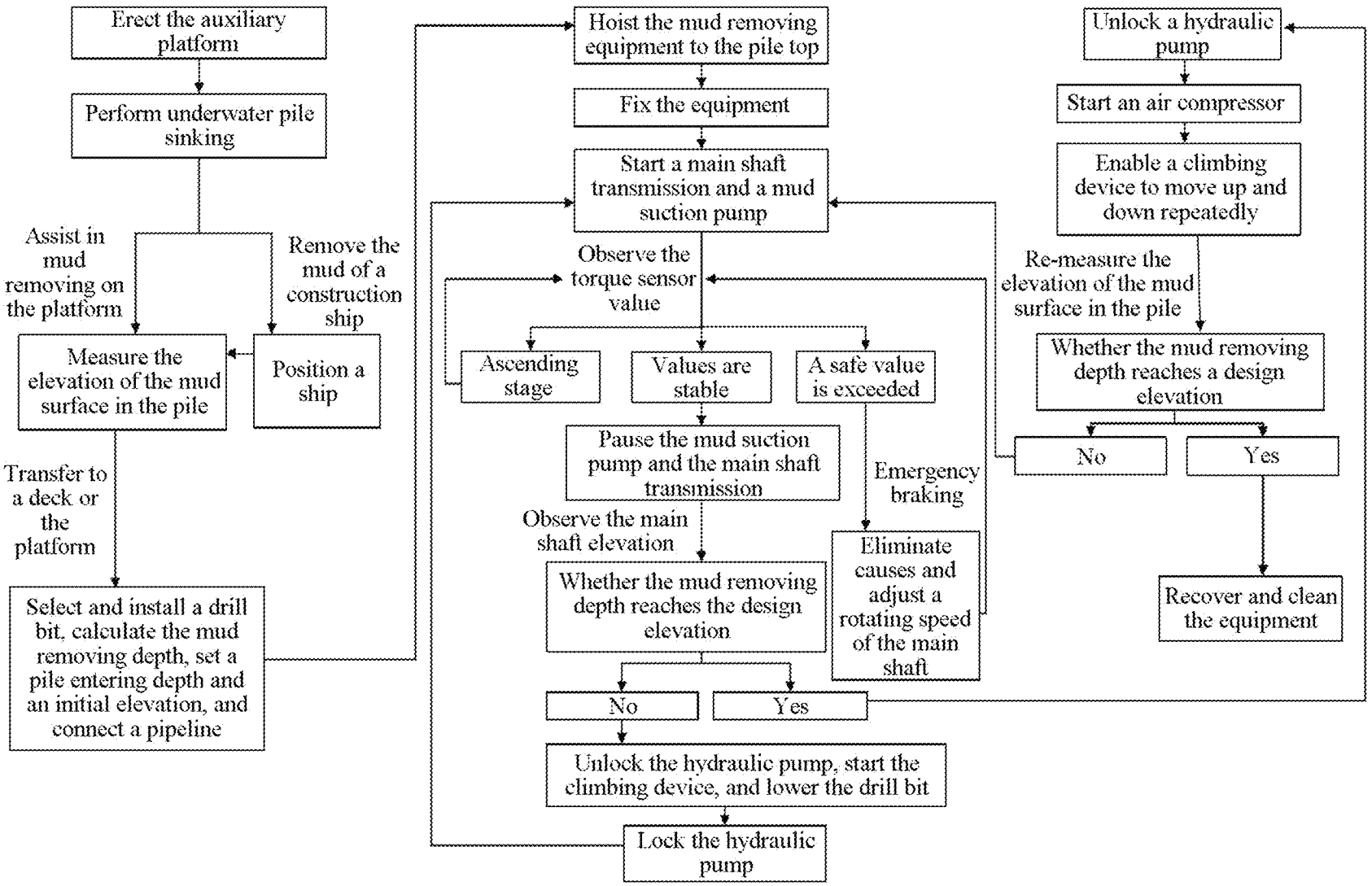
FIG. 2: a flowchart of a construction method for removing mud in a jacket steel pipe pile according to an embodiment of this application.
Figure 3:
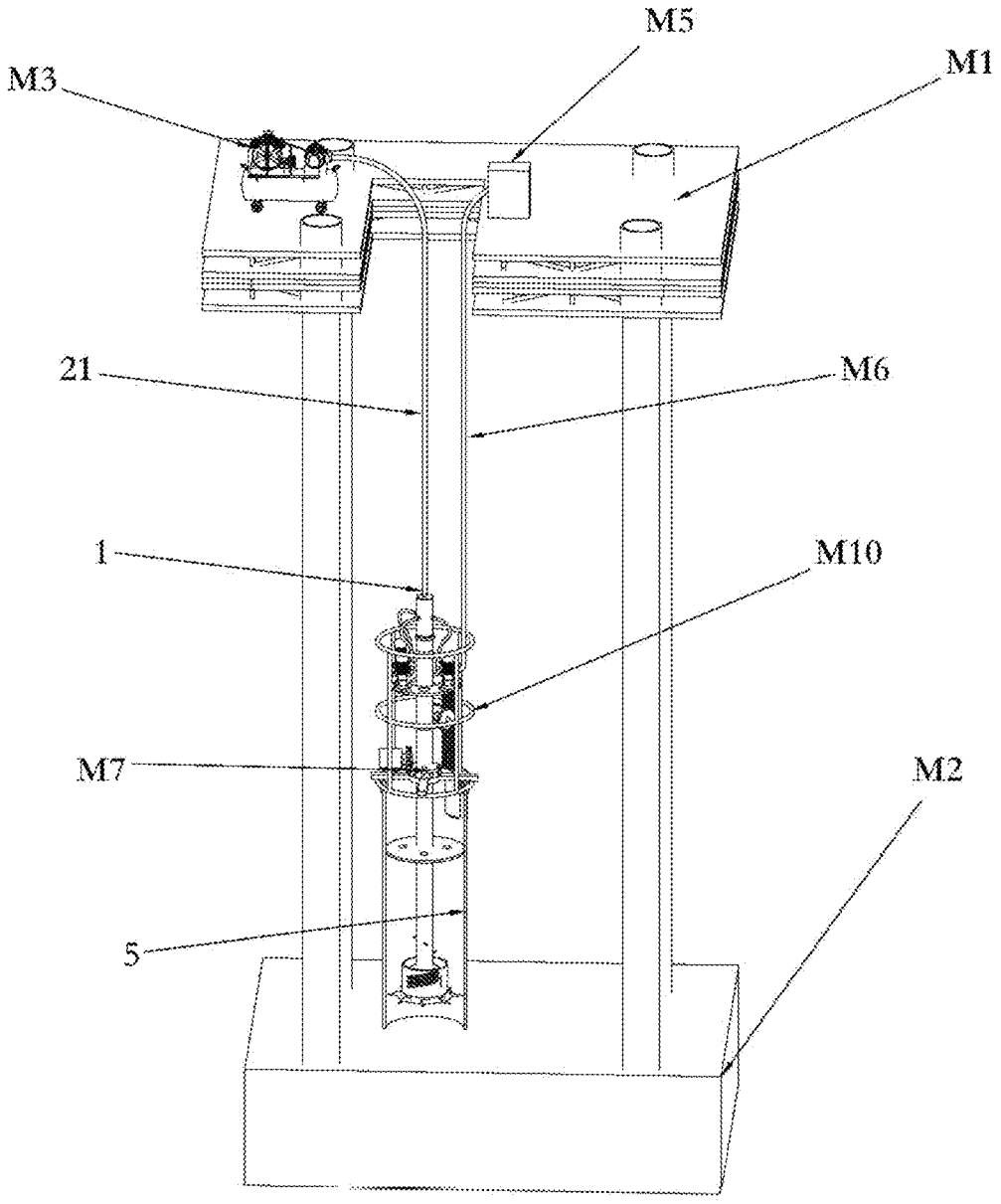
FIG. 3: a structure diagram 1 of mud removing equipment in a construction method for removing mud in a jacket steel pipe pile according to an embodiment of this application.
Figure 4:
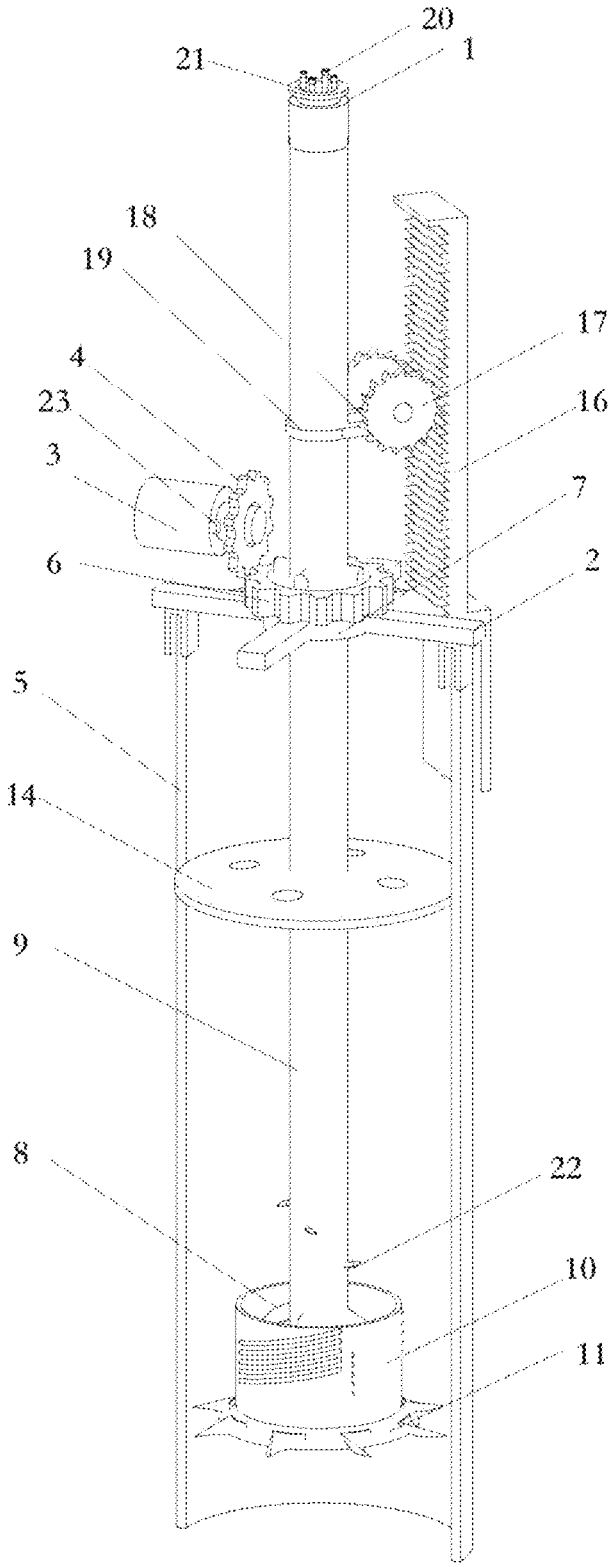
FIG. 4: a structure diagram 2 of mud removing equipment in a construction method for removing mud in a jacket steel pipe pile according to an embodiment of this application.
Figure 5:
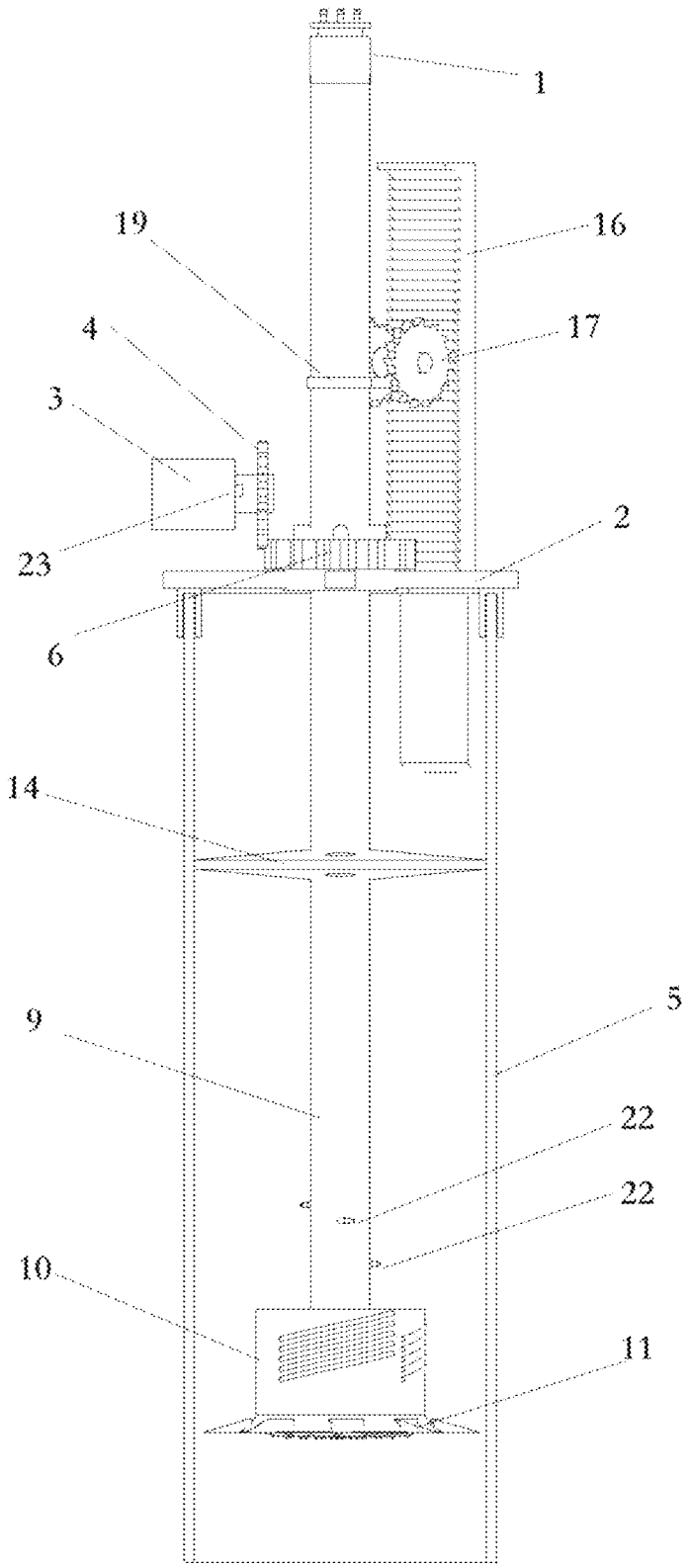
FIG. 5: a structure diagram 3 of mud removing equipment in a construction method for removing mud in a jacket steel pipe pile according to an embodiment of this application.
Figure 6:
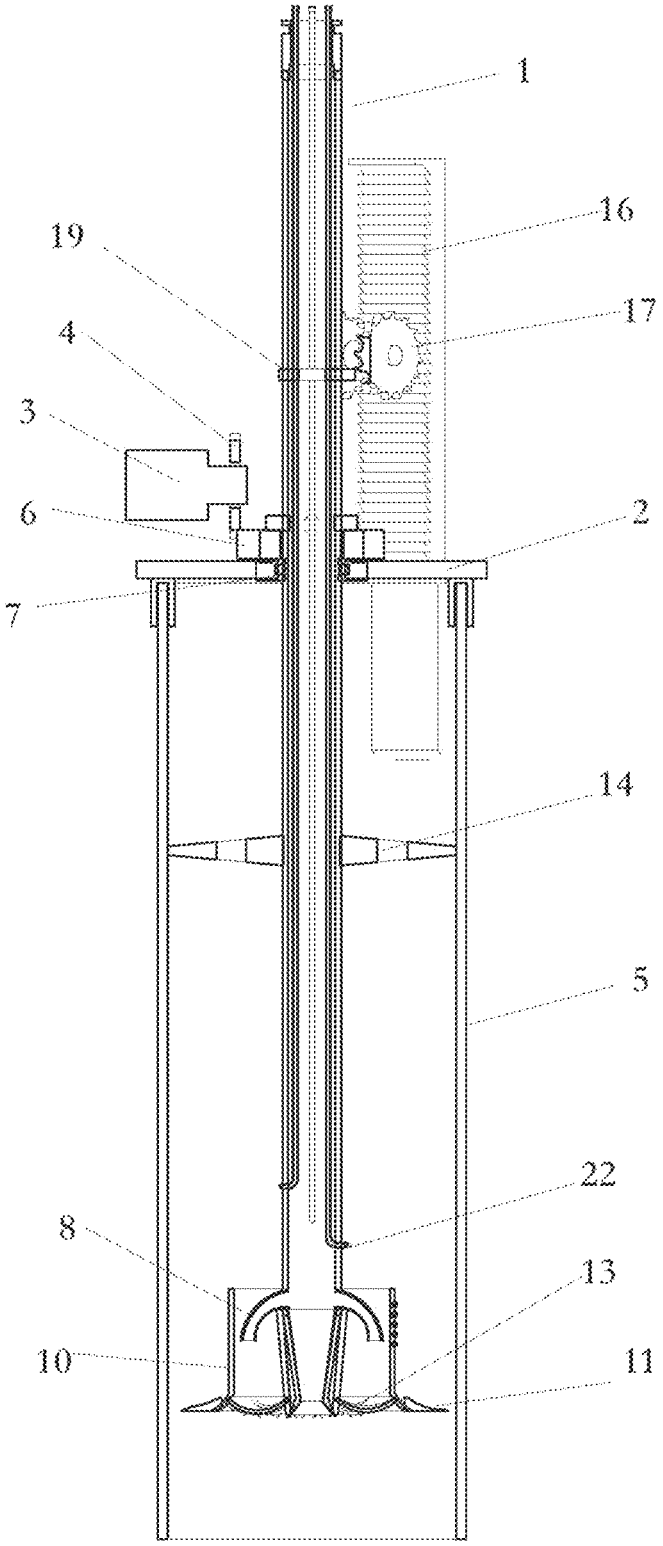
FIG. 6: a structure diagram 4 of mud removing equipment in a construction method for removing mud in a jacket steel pipe pile according to an embodiment of this application.

Continuing to refer to FIG. 2, in the above step 1, the offshore piling auxiliary platform M1 involved in the construction for removing mud in the steel pipe pile 5 has various forms in China at present, and the construction can be considered before the platform is dismantled, or the construction is carried out on a construction ship after the platform is dismantled according to specific forms. The piling auxiliary platform M1 involved in this embodiment is only indicated a part of the platform to achieve the illustration of the construction method. An involved sea level is an appendage mark M2. A control box M5 is further arranged on the auxiliary platform M1, and the control box M5 controls the mud removing equipment M7 through an equipment control circuit M6.

In the above step 2, the needed mud removing depth H=an elevation $H_1$ of the mud surface in the measured pile—an elevation $H_2$ of a designed mud surface in the pile.

The elevation of the mud surface in the pile can be measured at a pile opening by a diver using a measuring rope to hang a lead block and the like.

The above step 3 includes:

connecting an air compressor M3 connector on the platform or a construction deck with an adapter 1 of the mud removing equipment M7. High power needs to be configured according to construction requirements, so that efficiency and quality of the mud removing equipment M7 are improved, for example, four air compression pipelines 21 can be adopted to be converged to a unified joint through the adapter 1 to be connected with the air compressor M3. Further, preferably, the adapter 1 between an upper portion of the transmission main shaft 9 and the mud removing equipment M7, as well as between the air compressor M3 and the mud removing equipment M7, is a bearing type rotary joint, guaranteeing that the pipeline at the upper portion cannot be knotted to affect the construction when a lower portion of the transmission main shaft 9 rotates.

The above step 3 further includes: clamping the mud removing equipment M7 at a top portion of the steel pipe pile 5; further, installing the mud removing equipment M7 in a rigid lifting cage M10 (note: the rigid lifting cage can be made of steel). A lower frame of the rigid lifting cage is welded at a lower portion of the pile head support 2 of the mud removing equipment M7, and the center of the pile head support 2 is rotationally connected to the transmission main shaft 9 through a bearing 7. A clamping groove is formed in the lower portion of the pile head support 2 and the clamping groove is clamped at the end portion of the steel pipe pile 5.

In this embodiment, as shown in FIG. 3 to FIG. 6, further, preferably, the pile head support 2 includes: a plurality of pieces of rectangular steel connected together; the centers of the rectangular steel are rotationally connected with the transmission main shaft 9 through transmission bearings 7. Clamping grooves are formed in the lower portions of the rectangular steel, and the clamping grooves are clamped to the end portion of the steel pipe pile 5. According to this embodiment, the transmission main shaft 9 is installed on a pile head of the steel pipe pile 5, and in cooperation with the guide compass 14, a situation that due to the water flow effect, shaking is caused, the inner wall of the steel pipe pile 5 is impacted, and structural damage is caused is avoided. The guide compass 14 has the guide effect, and can also prevent shaking of the transmission main shaft 9, so that the transmission main shaft is prevented from colliding with the inner wall of the steel pipe pile 5.

Further, preferably, the pile head support 2 is provided with four pieces of rectangular steel perpendicular to one another; the clamping grooves are formed in lower portions of the rectangular steel, and the rectangular steel is clamped into the pile wall to be fixed during operation. According to this embodiment, only the four pieces of rectangular steel are arranged for explanation, and the protection range of the construction method is not limited.

According to the design of the rigid lifting cage M10, on one hand, equipment damage caused by collision is prevented, and on the other hand, a frame of the rigid lifting cage M10 is beneficial to fixing of the pipeline; and a frame at the lowermost portion of the rigid lifting cage M10 is welded to the lower portion of the pile head support 2 of the mud removing equipment M7, and stress is facilitated. In addition, the whole mud removing equipment M7 is installed in the specially-made rigid lifting cage M10, so that underwater installation by a diver is facilitated.

The above step 3 further includes: selecting a proper drill bit assembly to be installed on the transmission main shaft 9 of the mud removing equipment M7 on the platform or the construction deck according to the pile diameter, the soil needing to be removed and other factors.

The above step 3 further includes: according to the design elevation in the pile, in combination with the elevation, measured by the diver, of the mud surface in the pile, adjusting a climbing device in the mud removing equipment M7 and adjusting a length of the transmission main shaft 9, controlling a pile entering depth of the drill bit assembly, and starting the height adjusting hydraulic device to fix the transmission main shaft 9 and then unhooking the transmission main shaft.

An initial value of the climbing device=the elevation of the mud surface in the steel pipe pile 5, and a height of a rack in the climbing device>the design elevation in the steel pipe pile 5.

It is also to be noted that the mud entering depth of the drill bit assembly needs to consider the mud entering depth of the drill bit assembly by its own weight, and therefore the actual length of the transmission main shaft 9 is larger than the initial elevation of the mud surface in the steel pipe pile 5.

In this embodiment, the mud suction mechanism includes: a mud suction pump which is installed at the top portion of the transmission main shaft 9 through the adapter.

A mud suction pipe opening is formed in the bottom portion of the transmission main shaft 9. The mud suction pipe opening includes: a main pipe opening and a plurality of branch pipe openings. The main pipe opening is formed in the bottom portion of a drill bit assembly. The branch pipe openings are formed in a side wall of the transmission main shaft 9 and communicate with an internal channel of the transmission main shaft 9. And/or, the main pipe opening and the branch pipe openings are each of a horn mouth structure. And/or, cutting teeth are further arranged at the main pipe opening.

The above step 3 further includes: starting the driving assembly, under driving effect of the driving assembly, and adjusting a rotating speed of the transmission main shaft 9 and a rotating speed of the drill bit assembly installed at the bottom portion of the transmission main shaft 9. The rotating speed is adjusted according to factors such as the property of a soil layer in the steel pipe pile 5. The mud suction pump is started to remove the mud and pump the mud out of the steel pipe pile 5.

The driving assembly includes: a driving motor 3, a driving gear 4 and a driven gear 6. The driving gear 4 is installed at a driving end of the driving motor 3. The driven gear 6 is arranged on the transmission main shaft 9. The driving gear 4 is further engaged with the driven gear 6. Under driving effect of the driving motor 3, the transmission main shaft 9 is driven to do circumferential rotating movement. Through the arrangement of the driving assembly, the transmission main shaft 9 is driven to drive the drill bit assembly arranged at the bottom portion to rotate, then the mud at the bottom portion is stirred or stirred, and the mud removing operation in the pile is completed in cooperation with the mud suction mechanism. The rotating speed of the transmission main shaft 9 can be adjusted through the driving motor 3, and therefore the mud removing effect is achieved by rotating the drill bit assembly.

A torque sensor 23 is installed at the driving motor 3 of the driving assembly and connected with an emergency braking device. A torque value may be converted into an image form. If an initial value of the torque value exceeds a safety value, the emergency braking device is started to avoid damage to equipment. If the torque value is in a stable decreasing state, it indicates that the equipment is stably removing the mud. If the torque value decreases to a certain numerical value and fluctuates stably, it indicates that mud removing at the interval depth is completed.

Step 4 further includes: pausing the driving assembly and the mud suction pump, and increasing a pile entering depth of a drill bit by adjusting a climbing device till the needed mud removing depth is reached. The depth of completing mud removing can be calculated according to a rotating speed of a climbing transmission motor 18 in the climbing device and a diameter of a climbing gear 17.

If the expected mud removing depth is reached, the driving assembly and the mud suction pump are paused, the climbing device is started, the air compressor M3 is started to inject high-pressure air into the steel pipe pile 5, reciprocating lifting is performed in a mud removing depth interval, and the inner wall of the steel pipe pile 5 is removed. The construction process of mud removing can be speculated through a numerical value of the torque sensor 23; and if the numerical value is stable and does not decrease any more, it indicates that mud removing within a depth range is completed. In order to prevent the removed mud from being deposited at the pile bottom, the surplus amount of the mud removing depth needs to be obtained during mud removing. In order to guarantee later-period installation and grouting quality of a jacket, removing time of the mud removing interval is properly prolonged, and therefore optimal effect is achieved.

If the expected mud removing depth is not reached, the mud removing operation will be repeated until the expected mud removing depth is reached, then the driving assembly and the mud suction pump are paused, the climbing device is started, the air compressor M3 is started to inject high-pressure air into the steel pipe pile 5, reciprocating lifting is performed in the mud removing depth interval, and the inner wall of the steel pipe pile 5 is cleaned.

In this embodiment, the climbing device includes: a climbing rack 16, a climbing gear 17, a climbing transmission motor 18 and a climbing support 19.

The climbing gear 17 is installed on the transmission main shaft 9 through the climbing support 19. The climbing gear 17 is further engaged with the climbing rack 16. The climbing gear 17 is further installed at a driving end of the climbing transmission motor 18. The climbing rack 16 is longitudinally installed on the steel pipe pile 5.

Under the driving effect of the climbing transmission motor 18, the transmission main shaft 9 can move up and down in a vertical direction. Due to the arrangement of the climbing device, the whole equipment can ascend and descend freely, mud removing in the steel pipe pile 5 with different grouting connection heights can be achieved; and meanwhile, the length of the transmission main shaft 9 is adjusted along with mud removing, so that the method is suitable for underwater pile mud removing operation at different depths until mud removing is completed.

The adjustment interval of the climbing device is about +50 cm of a height of the drill bit assembly.

Scales are further arranged in the climbing rack 16, and thus the depth of the drill bit assembly can be conveniently measured. In this embodiment, preferably, in order to improve climbing stability, two climbing gears 17 are arranged. The two climbing gears 17 are driven by the climbing transmission motor 18 to ascend and descend the transmission main shaft 9.

In this embodiment, the climbing rack 16, the climbing gears 17 and the climbing transmission motor 18 are all arranged on the climbing support 19, and the climbing support 19 is connected with the transmission main shaft through the bearing 7.

In this embodiment, the control of the mud removing depth can be achieved through controllability of the rotating speed of the climbing transmission motor 18, the diameters of the climbing gears 17 and the like.

Definitely, in this embodiment, the climbing device can be arranged to be of a crawler-type or hydraulic or roller-type structure besides the gear and rack structure, that is, the climbing device can be suitable for a driving structure capable of driving the transmission main shaft 9 to move up and down in the vertical direction.

In this embodiment, the mud on the inner wall of the steel pipe pile 5 is mainly removed through a removing device. Specifically, the removing device includes: an air compression connector 20, an air compression pipeline 21 and air compression nozzles 22. The air compression pipeline 21 is arranged inside the transmission main shaft 9. The air compression nozzles 22 are arranged on the outer wall of the transmission main shaft 9 and communicate with the air compression pipeline 21. The air compression pipeline 21 is further connected with the air compressor M3 through the air compression connector 20. The removing device can automatically remove residual impurities on the inner wall of the steel pipe pile 5 in a reciprocating manner after mud removing is finished.

A plurality of air compression nozzles 22 are arranged, and the air compression nozzles 22 are bent in a tangential direction of the transmission main shaft 9; and the air compression nozzles 22 are arranged at different heights. For example, the plurality of air compression nozzles 22 can be arranged to be of a spiral ascending type structure.

Further, the air compression nozzles 22 are preferably conical openings.

In this embodiment, the air compression pipeline 21 is preferably composed of a plurality of steel pipes with small pipe diameters, and the steel pipes are uniformly arranged on the inner wall of the transmission main shaft 9. The air compression nozzles 22 can be arranged to be nozzles 22 with small outlets, and can increase the impact force of the ejected water flow, and thus the inner wall of the steel pipe pile 5 can be conveniently cleaned.

In this embodiment, a pipeline between the mud suction pump and the mud removing equipment M7 is a steel pipeline or a steel wire hose.

Further, preferably, the pipeline between the air compressor M3 and the mud removing equipment M7 is a rubber hose.

The driving assembly is further provided with the torque sensor 23, and the completed mud removing depth can be obtained based on the numerical value of the torque sensor 23 and in combination with the mud removing depth measured by construction. The rotating speed can be adjusted according to the torque, meanwhile, emergency braking can be carried out when the torque exceeds a safety value, so that the equipment is prevented from being damaged; and in addition, the construction process of mud removing in the pile can be determined according to the numerical value of the torque sensor 23.

The mud suction pumps are evenly distributed along the transmission main shaft 9, and the mud suction pumps are in bearing 7 type rotary connection with the transmission main shaft 9; and the mud suction pumps do not rotate along with the transmission main shaft 9. The total power of the mud suction pumps needs to be calculated according to the diameter of the pipeline inside the transmission main shaft 9, and thus it is guaranteed that the mud in the pile can be pumped out of the pile.

In the above step 4, after mud removing is finished, the air compressor M3 is started to clean mud left on the inner wall of the steel pipe pile 5 after removal, so that the later grouting quality is improved.

In this embodiment, the drill bit assembly includes: a mud barrel 10, an inner mud cutting turbine 13 and an outer mud cutting turbine 11. The inner mud cutting turbine 13 is detachably connected with the transmission main shaft 9. The outer mud cutting turbine 11 is arranged on an outer side of the inner mud cutting turbine 13. The mud barrel 10 is arranged between the inner mud cutting turbine 13 and the outer mud cutting turbine 11. The drill bit assembly is detachable and replaceable and adapts to different pipe diameters of steel pipe piles 5 and different soil properties. In this embodiment, the mud in the steel pipe piles 5 is cut, stirred and turned upwards through the inner mud cutting turbine 13 and the outer mud cutting turbine 11, the mud is stirred through a pumping suction branch pipe 8 to form slurry, and the slurry can be conveniently pumped out of the pile.

Further, threads matched with the outer side of the transmission main shaft 9 are arranged inside the inner mud cutting turbine 13 in the drill bit assembly. Bolt type connection is adopted, and pins are matched, so that different types of drill bit assemblies are replaced according to-be-constructed steel pipe piles 5 with different diameters.

A threaded tenon is further arranged on an outer side of the mud barrel 10. The tenon can be used as a mud guide groove, and the arrangement of the tenon enables the components of the whole drill bit assembly to be in streamline transition, so that the rotation resistance is reduced.

Further, the inner mud cutting turbine 13 and the outer mud cutting turbine 11 in the drill bit assembly can be replaced according to different geological conditions, so that the drill bit assembly is suitable for removing mud of different soil properties, and a spiral drill bit can be used for loose sand and the like. A turbine type drill bit can be used for removing thicker clay and the like so as to achieve mud removing in the pile.

Optionally, cutting teeth are arranged on the inner mud cutting turbine 13 and/or the outer mud cutting turbine 11. The arrangement of the cutting teeth can increase the mud cutting force and increase the mud removing speed.

In this embodiment, the cutting teeth are preferably arranged to be of a convex bullet-shaped structure. The number of the cutting teeth is not limited, and the cutting teeth can be arranged at intervals.

The part needing manual operation in the whole construction process is small; equipment installation and measurement of the elevation of the mud surface in the pile can be carried out in the front-back direction, so that underwater construction time of the diver is shortened, personnel safety is guaranteed, and construction costs are reduced. The depth of mud removing in the pile, the height of cleaning the inner wall in the pile and the like in the whole mud removing process can be controlled on the platform or the deck through professionals.

According to this application, the construction method for removing the mud in the steel pipe pile 5 is introduced from aspects of on-site equipment assembly, pipeline connection, device operation, construction sequence and the like for removing the mud in the underwater steel pipe pile 5, the construction effect is good, the efficiency is high, the personnel allocation requirement is low, the offshore operation window and the construction costs are reduced, and a powerful guarantee is provided for ensuring the safety and quality of an offshore wind turbine foundation. According to this application, construction is carried out based on existing mud removing equipment M7 and an offshore auxiliary piling platform, the equipment assembly is simple, the pipeline connection is convenient, and problems that the mud surface in the steel pipe pile 5 is not removed to the designed elevation, phenomena of pile bottom back silting and the like occur, and installation of an upper jacket is affected are effectively solved. In conclusion, this application has a good market application prospect.

In the description of this application, unless otherwise expressly specified or qualified, the terms "link", "connected", "fixed" shall be construed broadly, for example, they may be a fixed connection, may be a detachable connection, or may be integrated, or the connection may be a mechanical connection or an electrical connection; or the connection may be a direct connection, an indirect connection through an intermediate medium, internal communication between two components, or an interaction relationship between two components. A person of ordinary skill in the art may understand the specific meanings of the foregoing terms in this application according to specific situations.

In this application, unless otherwise expressly specified and qualified, the first feature "above" or "below" the second feature may include direct contact between the first and second features, or the first and second features are not in direct contact but through additional feature contact between them. Moreover, the first feature "above", at the "over", and "on" of the second feature includes the first feature directly above and obliquely above the second feature, or simply indicates that the first feature is horizontally higher than the second feature. The first feature is "below", at the "under", and "beneath" of the second feature includes the first feature directly below and diagonally below the second feature, or simply indicates that the horizontal height of the first feature is less than that of the second feature.

In the description of this embodiment, the terms "up", "down", "left", "right", etc., orientation or positional relationship are based on the orientation or positional relationship shown in the accompanying drawing, and are only for convenience of description and simplification of operation, and do not indicate or imply that the device or element referred to must have a specific orientation, be constructed and operated in a particular orientation, and therefore cannot be construed as a limitation on this application. In addition, the terms "first" and "second" are only used for distinguishing between descriptions and have no special meanings.

The above embodiments are only used for illustrating the technical solution of this application and are not limited, and this application is described in detail with reference to the preferred embodiment. A person of ordinary skill in the art shall understand that the technical solution of this application may be modified or equivalent replaced without departing from the spirit and scope of the technical solution of this application, and shall be covered within the scope of the claims of this application.

What is claimed is:

1. A construction method for removing a mud in a jacket steel pipe pile, comprising:

erecting a piling auxiliary platform, and performing underwater steel pipe pile sinking;

measuring an elevation of a mud surface in an underwater steel pipe pile, and calculating a height from the mud surface in the underwater steel pipe pile to a pile top and a needed mud removing depth according to a measurement result; wherein the needed mud removing depth H=an elevation $H_1$ of the mud surface in the underwater steel pipe pile—an elevation $H_2$ of a designed mud surface in the underwater steel pipe pile;

installing a mud removing equipment on the underwater steel pipe pile; and starting the mud removing equipment to carry out a mud removing operation, and when the needed mud removing depth is reached, pausing the mud removing equipment, and cleaning an inner wall of the underwater steel pipe pile; and when the mud removing operation does not reach a related elevation, repeating the mud removing operation till the mud removing operation reaches a standard;

wherein the mud removing equipment comprises a transmission main shaft, a mud suction mechanism, a pile head support, a driving assembly, and a drill bit assembly; the transmission main shaft is arranged inside the underwater steel pipe pile, and the transmission main shaft is of a hollow structure; the mud suction mechanism is installed at a top portion of the transmission main shaft; a center of the pile head support is rotationally connected with the transmission main shaft, and an outer side of the pile head support is installed at an end portion of the underwater steel pipe pile; the drill bit assembly is installed at a bottom portion of the transmission main shaft, and the drill bit assembly comprises a mud barrel, an inner mud cutting turbine, and an outer mud cutting turbine; the inner mud cutting turbine is detachably connected with the transmission main shaft, the outer mud cutting turbine is arranged on an outer side of the inner mud cutting turbine, and the mud barrel is arranged between the inner mud cutting turbine and the outer mud cutting turbine;

the driving assembly is further provided with a torque sensor, and a completed mud removing depth is obtained based on a numerical value of the torque sensor and in combination with a mud removing depth measured by a construction; and the underwater steel pipe pile is further provided a climbing device, wherein the climbing device comprises a climbing rack, a climbing gear, a climbing transmission motor, and a climbing support; the climbing gear is installed on the transmission main shaft through the climbing support, the climbing gear is further engaged with the climbing rack, and the climbing gear is further installed at a driving end of the climbing transmission motor; and the climbing rack is longitudinally installed on the underwater steel pipe pile.

2. The construction method for removing the mud in the jacket steel pipe pile according to claim 1, wherein the step of installing the mud removing equipment on the underwater steel pipe pile comprises:

connecting an air compressor connector on a platform or a construction deck with an adapter of the mud removing equipment;

and/or, clamping the mud removing equipment to a top portion of the underwater steel pipe pile;

and/or, adjusting the climbing device in the mud removing equipment and adjusting a length of the transmission main shaft, controlling a pile entering depth of the drill bit assembly, and starting a height adjusting hydraulic device to fix the transmission main shaft and then unhooking the transmission main shaft.

3. The construction method for removing the mud in the jacket steel pipe pile according to claim 2, wherein the mud removing equipment is installed in a rigid lifting cage; a lower frame of the rigid lifting cage is welded to a lower portion of the pile head support of the mud removing equipment, and the center of the pile head support is rotationally connected to the transmission main shaft through a bearing; and a clamping groove is formed in the lower portion of the pile head support and the clamping groove is connected to the end portion of the underwater steel pipe pile in a clamped mode.

4. The construction method for removing the mud in the jacket steel pipe pile according to claim 1, wherein the step of installing the mud removing equipment on the underwater steel pipe pile comprises: starting the driving assembly, and under a driving effect of the driving assembly, adjusting a rotating speed of the transmission main shaft and a rotating speed of the drill bit assembly installed at the bottom portion of the transmission main shaft; and/or, starting a mud suction pump to remove the mud and pumping the mud out of the underwater steel pipe pile.

5. The construction method for removing the mud in the jacket steel pipe pile according to claim 4, wherein the step of installing the mud removing equipment on the underwater steel pipe pile further comprises: pausing the driving assembly and the mud suction pump, and increasing a pile entering depth of a drill bit by adjusting the climbing device till the needed mud removing depth is reached.

6. The construction method for removing the mud in the jacket steel pipe pile according to claim 5, wherein when an expected mud removing depth is reached, pausing the driving assembly and the mud suction pump, starting the climbing device, starting an air compressor to inject high-pressure air into the underwater steel pipe pile, performing reciprocating lifting in a mud removing depth interval, and cleaning the inner wall of the underwater steel pipe pile; and when the expected mud removing depth is not reached, repeating the mud removing operation till the expected mud removing depth is reached, then pausing the driving assembly and the mud suction pump, starting the climbing device, starting the air compressor to inject the high-pressure air into the underwater steel pipe pile, performing the reciprocating lifting in the mud removing depth interval, and cleaning the inner wall of the underwater steel pipe pile.

7. The construction method for removing the mud in the jacket steel pipe pile according to claim 6, wherein a pipeline between the mud suction pump and the mud removing equipment is a steel pipeline or a steel wire hose, and/or, a pipeline between the air compressor and the mud removing equipment is a rubber hose.

8. The construction method for removing the mud in the jacket steel pipe pile according to claim 7, wherein the mud suction pumps are evenly distributed along the transmission main shaft, and the mud suction pumps are in bearing type rotary connection with the transmission main shaft.

9. The construction method for removing the mud in the jacket steel pipe pile according to claim 7, wherein the mud removing equipment is installed in a rigid lifting cage; a lower frame of the rigid lifting cage is welded to a lower portion of the pile head support of the mud removing equipment, and the center of the pile head support is rotationally connected to the transmission main shaft through a bearing; and a clamping groove is formed in the lower portion of the pile head support and the clamping groove is connected to the end portion of the underwater steel pipe pile in a clamped mode.

10. The construction method for removing the mud in the jacket steel pipe pile according to claim 4, wherein the mud suction pumps are evenly distributed along the transmission main shaft, and the mud suction pumps are in bearing type rotary connection with the transmission main shaft.

11. The construction method for removing the mud in the jacket steel pipe pile according to claim 4, wherein the mud removing equipment is installed in a rigid lifting cage; a lower frame of the rigid lifting cage is welded to a lower portion of the pile head support of the mud removing equipment, and the center of the pile head support is rotationally connected to the transmission main shaft through a bearing; and a clamping groove is formed in the lower portion of the pile head support and the clamping groove is connected to the end portion of the underwater steel pipe pile in a clamped mode.

12. The construction method for removing the mud in the jacket steel pipe pile according to claim 5, wherein the mud suction pumps are evenly distributed along the transmission main shaft, and the mud suction pumps are in bearing type rotary connection with the transmission main shaft.

13. The construction method for removing the mud in the jacket steel pipe pile according to claim 5, wherein the mud removing equipment is installed in a rigid lifting cage; a lower frame of the rigid lifting cage is welded to a lower portion of the pile head support of the mud removing equipment, and the center of the pile head support is rotationally connected to the transmission main shaft through a bearing; and a clamping groove is formed in the lower portion of the pile head support and the clamping groove is connected to the end portion of the underwater steel pipe pile in a clamped mode.

14. The construction method for removing the mud in the jacket steel pipe pile according to claim 6, wherein the mud suction pumps are evenly distributed along the transmission main shaft, and the mud suction pumps are in bearing type rotary connection with the transmission main shaft.

15. The construction method for removing the mud in the jacket steel pipe pile according to claim 6, wherein the mud removing equipment is installed in a rigid lifting cage; a lower frame of the rigid lifting cage is welded to a lower portion of the pile head support of the mud removing equipment, and the center of the pile head support is rotationally connected to the transmission main shaft through a bearing; and a clamping groove is formed in the lower portion of the pile head support and the clamping groove is connected to the end portion of the underwater steel pipe pile in a clamped mode.

16. The construction method for removing the mud in the jacket steel pipe pile according to claim 1, wherein the mud removing equipment is installed in a rigid lifting cage; a lower frame of the rigid lifting cage is welded to a lower portion of the pile head support of the mud removing equipment, and the center of the pile head support is rotationally connected to the transmission main shaft through a bearing; and a clamping groove is formed in the lower portion of the pile head support and the clamping groove is connected to the end portion of the underwater steel pipe pile in a clamped mode.

* * * * *